US007862664B2

(12) United States Patent
Choi et al.

(10) Patent No.: US 7,862,664 B2
(45) Date of Patent: Jan. 4, 2011

(54) DISHWASHER WITH ADJUSTABLE BASKET(S)

(75) Inventors: Yong Jin Choi, Seoul (KR); Nung Seo Park, Seoul (KR); Young Hwan Park, Seoul (KR); Gap Su Shin, Chungju-si (KR)

(73) Assignee: LG Electronics Inc., Seoul (KR)

( * ) Notice: Subject to any disclaimer, the term of this patent is extended or adjusted under 35 U.S.C. 154(b) by 501 days.

(21) Appl. No.: 11/846,632

(22) Filed: Aug. 29, 2007

(65) Prior Publication Data

US 2008/0072937 A1 Mar. 27, 2008

(30) Foreign Application Priority Data

Sep. 21, 2006 (KR) ..... 10-2006-0091858

(51) Int. Cl.
*B08B 3/00* (2006.01)

(52) U.S. Cl. ..... 134/56 D; 134/57 D; 134/58 D; 134/201

(58) Field of Classification Search ..... 134/56 D
See application file for complete search history.

(56) References Cited

U.S. PATENT DOCUMENTS

| | | | | |
|---|---|---|---|---|
| 5,595,200 | A * | 1/1997 | Favaro | 134/201 |
| 6,945,421 | B2 * | 9/2005 | Phifer | 220/486 |
| 2005/0039782 | A1 * | 2/2005 | Kim | 134/58 D |
| 2006/0219271 | A1 * | 10/2006 | Feddema et al. | 134/56 D |

FOREIGN PATENT DOCUMENTS

DE 3004110 A * 8/1981

OTHER PUBLICATIONS

Schroder, Manfred, Feb. 1980, DE 3004110, English machine translation.*

* cited by examiner

*Primary Examiner*—Michael Barr
*Assistant Examiner*—Jason Y Ko
(74) *Attorney, Agent, or Firm*—KED & Associates LLP

(57) ABSTRACT

A dishwasher is disclosed which includes a washing cabinet, a frame disposed within the washing cabinet, and a basket, which is placed on the frame, and whose height is adjustable by a back and forth movement. With this construction, there is no need to lift the basket, rotate it 90°, and reposition the basket to adjust a height of the basket. Rather, it is possible to adjust the height of the basket by a simple operation of pulling the basket forward or pushing it rearward.

21 Claims, 11 Drawing Sheets

DISHWASHER WITH ADJUSTABLE BASKET(S)

This Nonprovisional application claims priority under 35 U.S.C. §119(a) to Korean Patent Application No. 10-2006-0091858 filed in Korea on Sep. 21, 2006, the entire contents of which are hereby incorporated by reference.

BACKGROUND

1. Field

A dishwasher with adjustable basket(s) is disclosed herein.

2. Description of the Related Art

A dishwasher is an apparatus, which washes food remnants adhered to culinary tools (hereinafter, referred to as "dishes"), including dishes, and cutlery, such as knives and scoops, using a detergent and wash water. The dishwasher is provided with racks for placing dishes thereon inside a washing cabinet of the dishwasher, which are linearly moveable backward and forward to be inserted into and withdrawn from the washing cabinet. However, related art dishwashers have various disadvantages.

BRIEF DESCRIPTION OF THE DRAWINGS

Embodiments will be described in detail with reference to the following drawings in which like reference numerals refer to like elements, and wherein.

DETAILED DESCRIPTION

Hereinafter, a dishwasher in accordance with embodiments will be described in detail with reference to the accompanying drawings.

Figure 1:
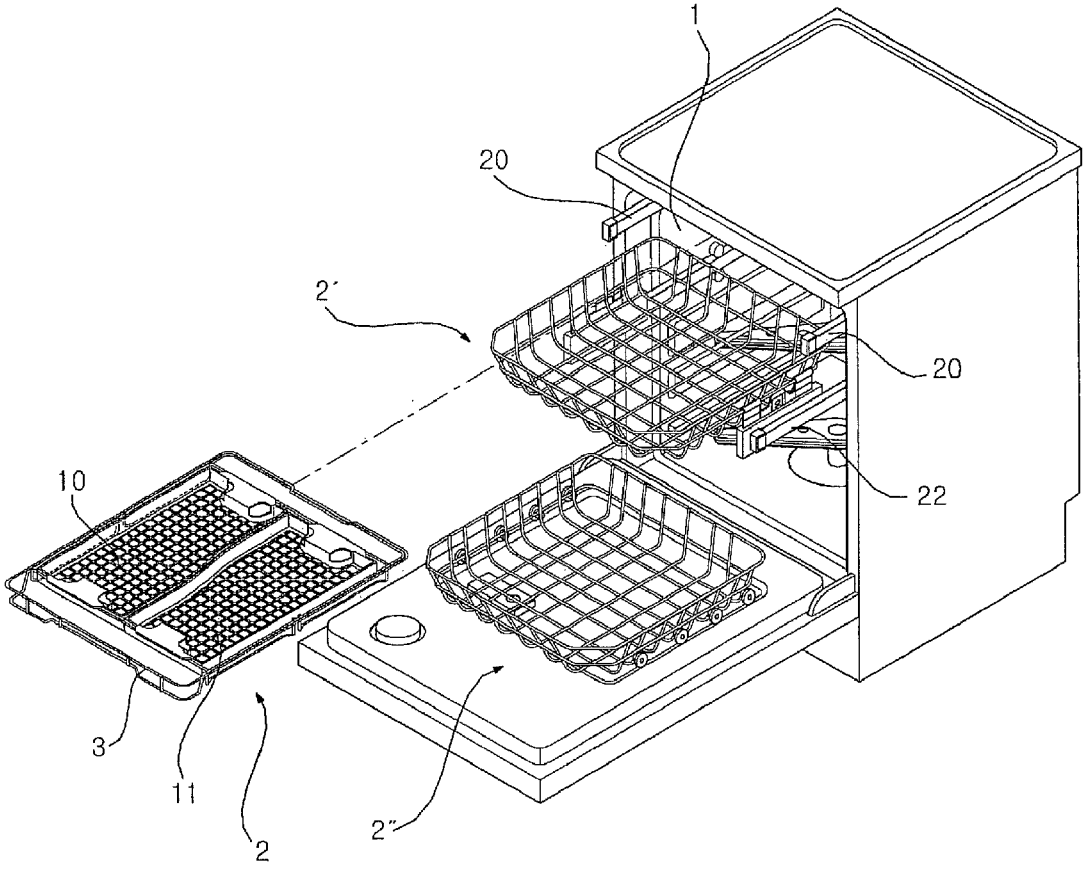
FIG. 1 is an exploded perspective view of a dishwasher according to an embodiment.

FIG. 1 is a partial exploded perspective view of a dishwasher according to an embodiment. The dishwasher of FIG. 1 may include a washing tub or cabinet 1 and a plurality of rack assemblies 2, 2', and 2". Guides 20 and 22, which guide linear movement of the rack assemblies 2 and 2' on which dishes are placed, may be disposed inside the washing cabinet 1. The rack assemblies 2, 2', and 2" may be vertically spaced from each other. Culinary tools, and cutlery, such as knives and scoops, may be mainly placed on rack assembly 2, while dishes may be mainly placed on the other rack assemblies 2' and 2". The rack assembly 2 may include a frame 3 guided by the guide 20 and baskets 10 and 11 which may be placed on the frame 3 and may be attached to and detached from the frame 3 so as to be height-adjustable.

Figure 2:
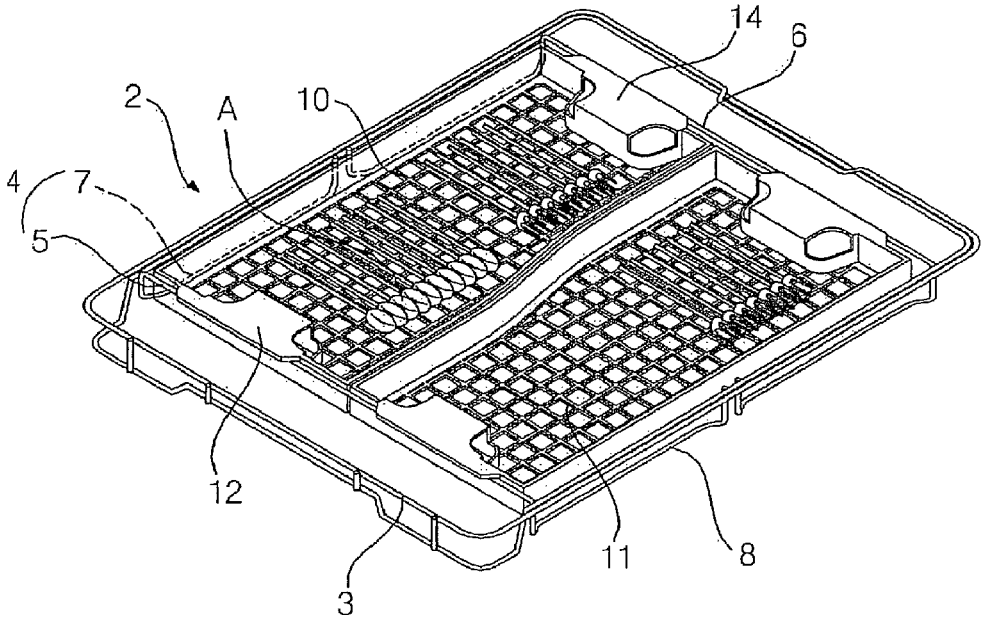
FIG. 2 is a perspective view of baskets of a rack assembly of FIG. 1 in a high position.
Figure 3:
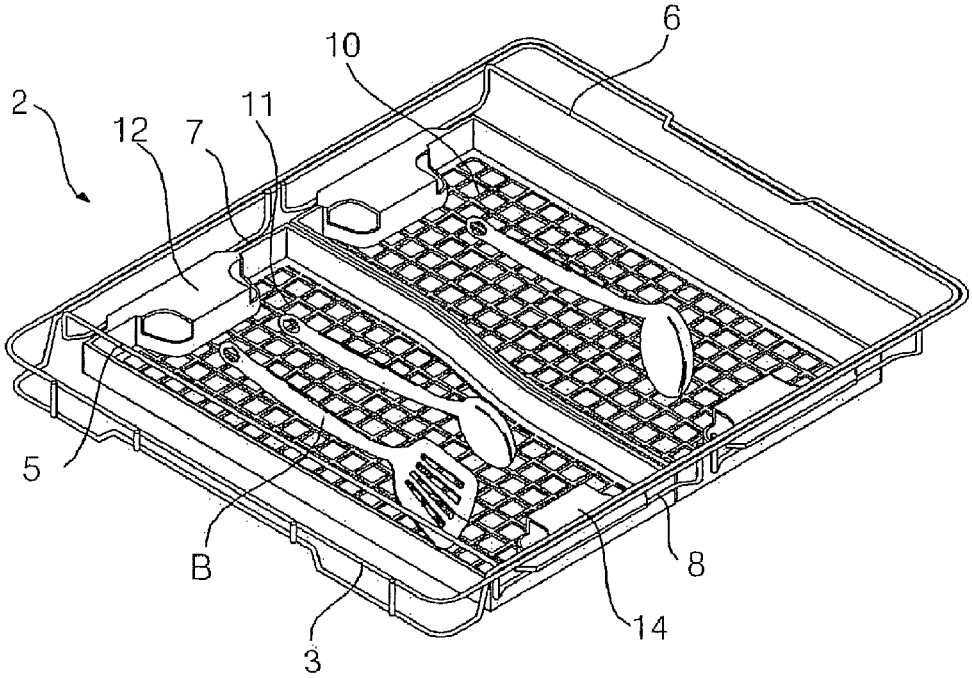
FIG. 3 is a perspective view of baskets of a rack assembly of FIG. 1 in a low position.

FIG. 2 is a perspective view of baskets of a rack assembly of FIG. 1 in a high position. FIG. 3 is a perspective view of baskets of a rack assembly of FIG. 1 in a low position.

As shown in FIGS. 2 and 3, the rack assembly 2 may include frame 3 and baskets 10 and 11. The baskets 10 and 11 may each have a first hanging member 12 and a second hanging member 14 that are provided on opposite sides, for example, to the front and rear or to the left and right. The frame 3 may have a stopping member 4 on which the hanging members 12 and 14 of the basket 10 are placed. The stopping member 4 may be provided at all of the four positions (front, left, rear, and right sides).

The stopping member 4, as shown in FIG. 2, may have a front bar 5 and a rear bar 6 disposed longitudinally to the left and right, for placing and stopping the first hanging member 12 and second hanging member 14 of the basket 10, and a left bar 7 and a right bar 8 disposed longitudinally to the front and rear, for placing and stopping the first hanging member 12 and second hanging member 14. As shown in FIGS. 1 and 3, the left bar 7 and the right bar 8 may be curved to have a smaller height than the front bar 5 and the rear bar 6, so that a height of the basket 10 is greater when the first hanging member 12 and second hanging member 14 of the basket 10 are positioned to the front and rear and a height of the basket 10 is less when the first hanging member 12 and second hanging member 14 of the basket 10 are positioned at the left and right sides.

An operation of adjusting a basket height of the dishwasher constructed as set forth above will be described herein below.

First, in a case where cutlery A, such as a spoon or knife, which has a small length when laid in the basket 10, is placed in the basket 10, as shown in FIG. 2, the basket 10 may be disposed so that the first hanging member 12 and the second hanging member 14 are positioned to the front and rear, and the first hanging member 12 and the second hanging member 14 are hung from the front bar 5 and the rear bar 6. On the other hand, in a case where cutlery B, such as a scoop, which has a large length when laid in the basket 10, is placed in the basket 10, as shown in FIG. 3, the basket 10 may be rotated 90° so that the first hanging member 12 and the second hanging member 14 are positioned to the front and rear, and the first hanging member 12 and the second hanging member 14 are hung from the left bar 7 and the tight bar 8.

However, the dishwasher according to this embodiment is problematic in that it is not easy to adjust the height of the basket 10 because the rack assembly 2 has to be taken out of the washing cabinet 1 in order to adjust the height of the basket 10, the basket 10 must then be lifted from the frame 3 to rotate it 90°, and then placed again on the frame 3. Additionally, the dishwasher according to this embodiment has respective stopping members 4 for front, rear, left, and right sides of the frame 3, thereby making the structure complicated and increasing the manufacturing cost.

Figure 4:
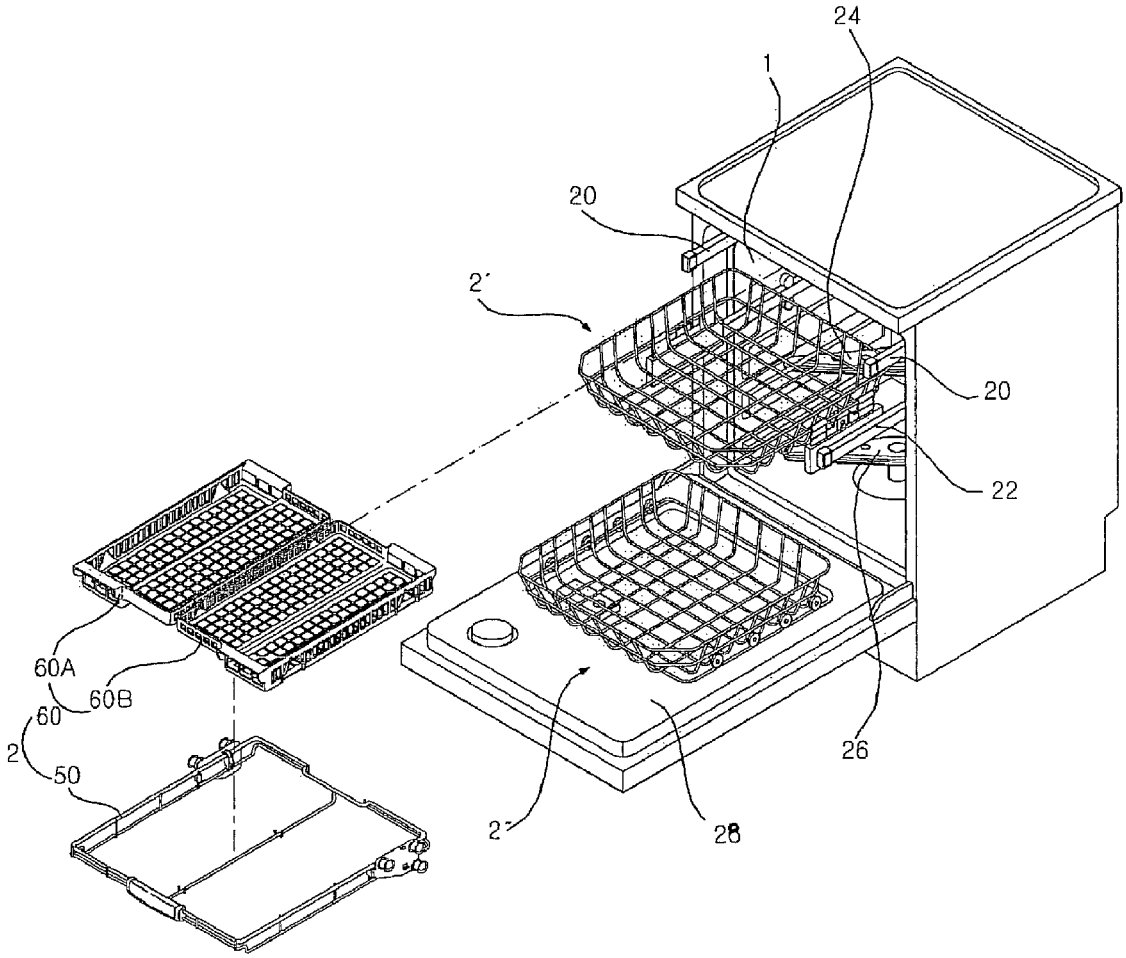
FIG. 4 is an exploded perspective view of a dishwasher according to another embodiment.
Figure 5:
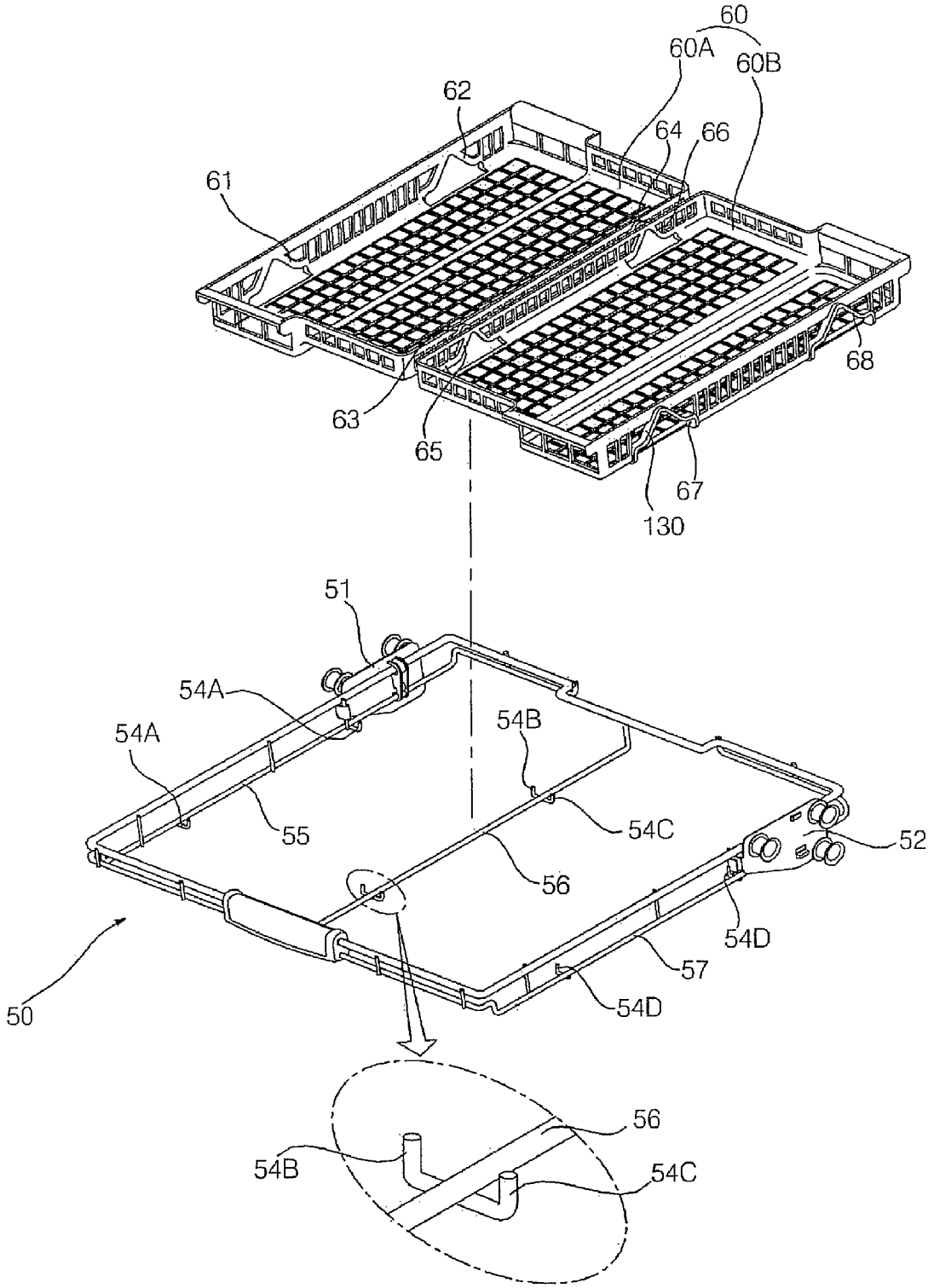
FIG. 5 is an exploded perspective view of a frame and a basket of a rack assembly of FIG. 4.
Figure 6:
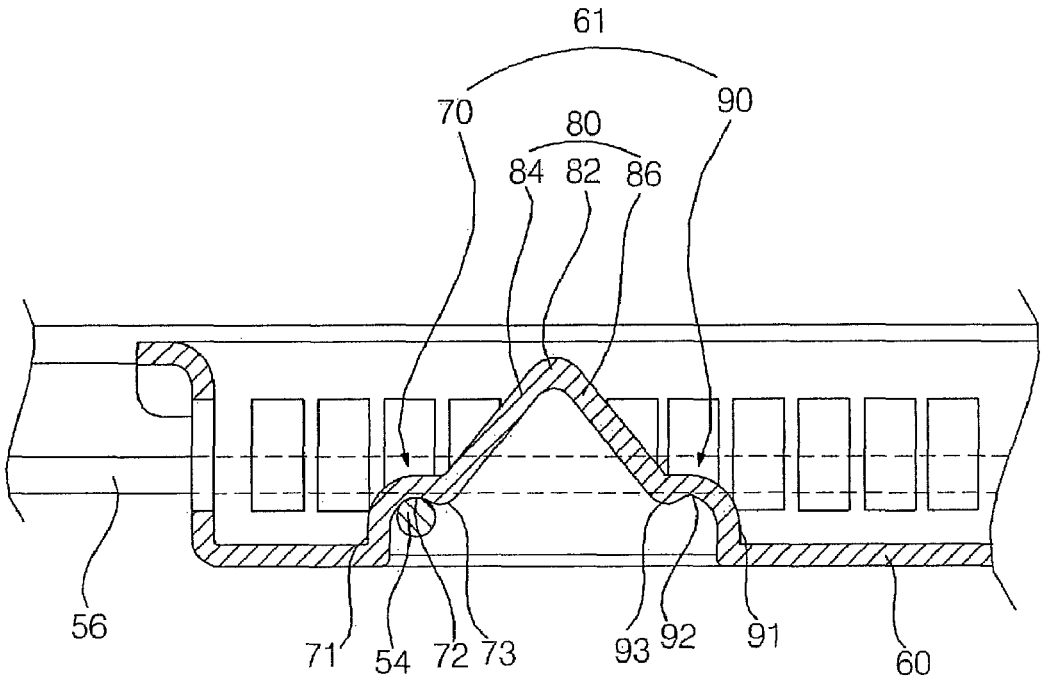
FIG. 6 is a partial cross sectional view of a basket of a rack assembly of FIG. 4 disposed in an upper position.
Figure 7:
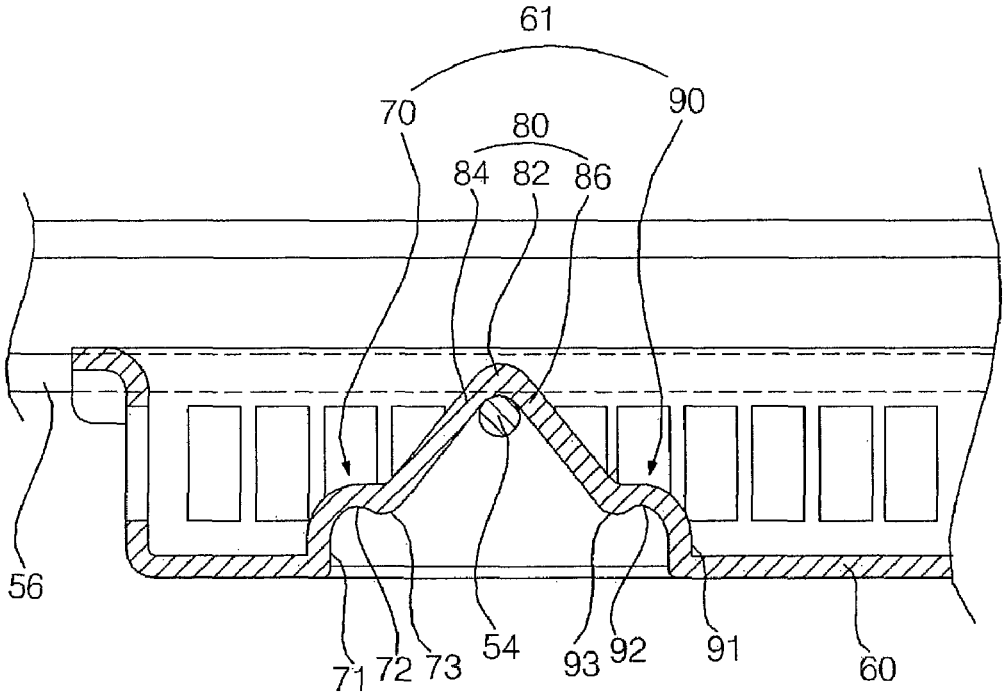
FIG. 7 is a partial cross sectional view of a basket of a rack assembly of FIG. 4 disposed in a lower position.

FIG. 4 is an exploded perspective view of a dishwasher according to another embodiment. FIG. 5 is an exploded perspective view of a frame and a basket of a rack assembly of FIG. 4. FIG. 6 is a partial cross sectional view of a basket of a rack assembly of FIG. 4 disposed in an upper position. FIG. 7 is a partial cross sectional view of a basket of a rack assembly of FIG. 4 disposed in a lower position. Like reference numerals have been used for elements identical with or equivalent to those of the dishwasher of FIGS. 1-3, and repetitive detailed explanation has been omitted.

The dishwasher according to this embodiment may include, as shown in FIG. 4, a washing cabinet 1 and a plurality of rack assemblies 2, 2', and 2" disposed inside the washing cabinet 1. The rack assemblies 2, 2', and 2" may be to be vertically spaced apart from one another. Guides 20 and 22 that guide linear (backward and forward) movement of rack assemblies 2, 2' may be provided inside the washing cabinet 1 to insert into and withdraw the rack assemblies from the washing cabinet 1. Also, nozzles 24 and 26 that spray washing water toward the rack assemblies 2, 2', and 2" may be provided inside the washing cabinet 1. A door 28 for opening and closing a front opening of the washing cabinet may be provided at a front of the washing cabinet 1

A sump (not shown) for collecting washing water may be installed at a lower portion of the washing cabinet 1. A pump apparatus that pumps washing water in the sump toward the nozzles 24 and 26, a water supply apparatus that supplies washing water to the inside of the sump, and a drainage apparatus that drains washing water in the sump to outside may be connected to the sump.

At least one of the plurality of rack assemblies 2, 2', and 2", the rack assembly 2' or 2" may be configured to receive plates or similar dishware placed thereon and the other rack assembly 2 may be configured to receive culinary tools placed thereon. All or some of the rack assemblies 2, 2', and 2" may be formed in a structure capable of height adjustment. Alternately, only one rack assembly 2 thereof may be formed in a structure capable of height adjustment. Hereinafter, a detailed description will be given with respect to a case in which the rack assembly 2 disposed at an uppermost side of the washing cabinet 1, among the plurality of rack assemblies 2, 2', and 2", is formed in a structure capable of height adjustment, and cutlery or culinary tools may be placed on the rack assembly 2.

The rack assembly 2 capable of height adjustment may include, as shown in FIGS. 4 to 7, a frame 50 and a basket 60 or baskets 60A, 60B, which is/are placed on the frame 50, and whose height is/are adjustable by backward and forward movement. The frame 50 may be made of steel and formed overall in a rectangular shape. Roller apparatuses 51 and 52, which may include at least one roller, may be installed at rear portions of the left and right sides of the frame 50, and may be configured to be slidably guided backward and forward along the guides 20.

The frame 50 may include ribs 54, onto which the basket 60 (60A, 60B) may be placed. The ribs 54 may project in left and/or right directions from bar portions 55, 56, and 57 which extend longitudinally between a front end and a rear end of the frame 50. The ribs 54 may include horizontal portions which horizontally project from the bar portions 55, 56, and 57 and vertical portions that extend or curve upward from ends of the horizontal portion, as shown in FIG. 5. That is, cross sections of the ribs 54 may be formed in a '⌋'-shape extending from the bar portions 55, 56, and 57 of the frame 50. The horizontal portions of the ribs 54 may be formed in a cylindrical shape so that the basket 60 (60A, 60B) may easily slide along the ribs 54 at the time of backward and forward movement of the basket 60 (60A, 60B).

The ribs 54 may include a left rib 54A that projects toward the right from the left bar portion 55, a center left rib 54B and a center right rib 54C that projects toward the left and right from the center bar portion 56, and a right rib 54D that projects toward the left from the right bar portion 57. A plurality of each of the ribs 54A, 54B, 54C, and 54D may extend from the bar portions 55, 56, and 57 spaced apart from each other in a front-to-rear direction. In the embodiments of FIGS. 4-12 front ribs may be formed between the center and front end of the bar portions 55, 56, and 57, and rear ribs may be formed between the center and rear end of the bar portions 55, 56, and 57.

The basket 60 may be injection-molded from, for example, a synthetic resin. Further, one basket 60*a* little smaller than the frame 50 may be placed on the frame 50, or two baskets 60A and 60B approximately half the size of the frame 50 may be positioned at the left and right sides of the frame 50. Hereinafter, an embodiment in which two baskets 60A and 60B are placed on the frame 50 positioned at the left and right sides will be discussed. The left basket 60A may be placed on the left rib 54A and the center left rib 54B, while the right basket 60B may be placed on the center right rib 54C and the right rib 54D.

In the case that cutlery, such as a spoon or knife, having a small length when laid laterally is placed on the basket 60 (60A, 60B), the basket 60 (60A, 60B) may be placed high up on the frame 50 so that sufficient storage space may be provided on a top of the rack 2' where the cutlery is placed. On the other hand, in the case that a culinary tool, such as a scoop, having a large length when laid laterally is placed on the basket 60 (60A, 60B), the basket (60A, 60B) may be placed low down on the frame 50 to prevent the culinary tool from coming into contact with an upper plate portion of the washing cabinet 1.

The basket 60 (60A, 60B) may be formed using a multistage projection structure in which the portions to be placed on the ribs 54 are projected laterally from the basket 60, or in a multistage recess structure in which portions to be placed on the ribs 54 are recessed into the basket 60. Hereinafter, a description thereof will be made with respect to a case in which the basket 60 is formed in a multistage recess structure in which portions to be placed on the ribs 54 are recessed upward from a lower side of the basket 60 (60A, 60B).

In the basket 60 (60A, 60B), the aforementioned multistage recess portions (hereinafter, referred to as "recess portions") may be formed corresponding to the ribs 54. The recess portions may be formed in a front-to-rear direction with an interval therebetween as long as the spacing corresponds to the spacing between the corresponding front and rear ribs.

That is, left front and rear recess portions 61 and 62 (placed on the left ribs 54A) may be formed at front and rear portions of the left portion of the left basket 60A, and right front and rear recess portions 63 and 64 (placed on the center left ribs 54B) may be formed at the front and rear of the right portion thereof. Also, left front and rear recess portions 65 and 66

(placed on the right center ribs 54C) may be formed at the front and rear of the left portion of the right basket 60B, and right front and rear recess portions 67 and 68 (placed on the right ribs 54D) may be formed at the front and rear of the right portion thereof. Meanwhile, the aforementioned recess portions 61, 62, 63, 64, 65, 66, 67, and 68 of the basket 60 may be constructed in the same structure, and thus only one of the recess portions 61 will be described in detail herein below.

As shown in FIGS. 6 and 7, the recess portion 61 includes a plurality of hanging portions 70, 80, and 90. The height of the hanging portion 80 may be different from the height of the other hanging portions 70 and 90. That is, the lower hanging portions 70 and 90 may have a lower height than the upper hanging portion 80. Further, the lower hanging portions 70 and 90 and the upper hanging portion 80 may be formed successively in the front-to-rear direction, or may be spaced from each other in the front-to-rear direction.

If the plurality of hanging portions 70, 80, and 90 are formed successively, the lower hanging portions 70 and 90 and the upper hanging portion 80 are placed successively on the ribs 54, thereby minimizing a width of back and forth movement of the basket 60 (60A, 60B) and easily adjusting the height thereof. On the other hand, if the plurality of hanging portions 70, 80, and 90 are spaced apart from each other, the lower hanging portions 70 and 90 and the upper hanging portion 80 are placed on the ribs 54 at a predetermined interval from each other, thereby increasing the width of movement of the basket 60 (60A, 60B) and decreasing the feeling of manipulation. Hereinafter, a description thereof will be made with respect to a case in which the plurality of hanging portions 70, 80, and 90 are formed successively.

Each of the upper ends of the plurality of hanging portions 70, 80, and 90 may have a height difference greater than three stages. Hereinafter, a description thereof will be made with respect to a case in which each upper end has a height difference in two stages.

As shown in FIGS. 6-7, the lower hanging portions 70 and 90 may be formed at a front and rear of the upper hanging portion 80. That is, the front lower hanging portion 70 may be formed at the front side in the front-to-rear direction of the basket 60 (60A, 60B), the upper hanging portion 80 may be formed at a center, and the rear lower hanging portion 90 may be formed at the rear side.

The lower hanging portions 70 and 90 may be stepped from the lower end of the basket 60 (60A, 60B). Further, the lower hanging portions 70 and 90 may be the same shape and may be symmetrical with respect to the upper hanging portion 80.

The front lower hanging portion 70 may have a linear portion 71 formed extending upward in a linear shape from the lower end of the basket 60 (60A, 60B) and a round portion 72 formed on an upper end of the linear portion 71, for partially surrounding an outer peripheral surface of the rib 54. A boundary region 73 between the round portion 72 and the upper hanging portion 70 may have a lower height than the upper end of the round portion 72 so that the boundary region 73 may be stopped at the front of the ribs 54 when the round portion 72 is placed on the ribs 54.

The upper end 82 of the upper hanging portion 80 may be higher than the front lower hanging portion 70 and the rear lower hanging portion 90. The upper hanging portion 80 may include sloping portions 84 and 86 that are sloped at portions between the upper end 82 and the front and rear lower hanging portions 70 and 90, so that it is formed in a cross sectional configuration of an approximately 'A' shape. Further, the upper end 82 of the upper hanging portion 80 may be formed in such a shape such that it corresponds to the ribs 54, for example, in a rounded shape, in order to reduce the height of the basket 60 (60A, 60B) as much as possible.

The rear lower hanging portion 90 may have a linear portion 91 formed upward in a linear shape from the lower end of the basket 60 (60A, 60B) and a round portion 92 formed at an upper end of the linear portion 91, for partially surrounding the outer peripheral surfaces of the ribs 54. A boundary region 93 between the round portion 92 and the lower hanging portion 90 may have a lower height than the upper end of the round portion 92 so that the boundary region 93 may be stopped at the rear of the ribs 54 when the round portion 92 is placed on the ribs 54.

Reference numeral 130 in FIG. 5 represents ribs projected along sides of the plurality of hanging portions 70, 80, and 90. The ribs 130 reinforce a strength of the hanging portions 70, 80, and 90 and help a user to easily identify the hanging portions 70, 80, and 90.

The operation of an embodiment constructed as discussed above will be described herein below.

First, when the recess portion 61 of the basket 60 (60A, 60B) is placed on the ribs 54 and the basket 60 (60A, 60B) is pushed rearward, as shown in FIG. 6, the front lower hanging portion 70 is placed on the ribs 54 and the basket 60 (60A, 60B) stopped at the front and rear and lower side of the ribs 54, and the basket 60 (60A, 60B) is supported on the ribs 54 in an upper position or overall heightened state. On the other hand, when the recess portion 61 of the basket 60 (60A, 60B) is placed on the ribs 54 and the basket 60 (60A, 60B) is pulled forward, the basket 60 is stopped at the front and rear and lower side of the ribs 54 as the rear lower hanging portion 90 of the plurality of hanging portions 70, 80, and 90 is placed on the ribs 54, and the basket 60 (60A, 60B) is supported on the ribs 54 in an upper position or overall heightened state as seen in the case where the front lower hanging portion 70 is supported on the ribs 54.

Meanwhile, when the basket 60 (60A, 60B) is pulled forward or pushed rearward, with one of the lower hanging portions 70 and 90 of the basket 60 (60A, 60B) being placed on the ribs 54, the boundary region 73 or 93 slides along the ribs 54, the position of the basket 60 (60A, 60B) is slightly moved in a back and forth direction as its height is decreased, and the sloping portions 84 and 86 of the upper hanging portion 80 are positioned at the front and rear of the ribs 54.

As shown in FIG. 7, when the upper end 82 of the upper hanging portion 80 is placed on the ribs 54, the basket 60 (60A, 60B) is stopped at the front and rear and lower side of the ribs 54, and the basket 60 (60A, 60B) is supported on the ribs 54 in a lower position or state.

Figure 8:
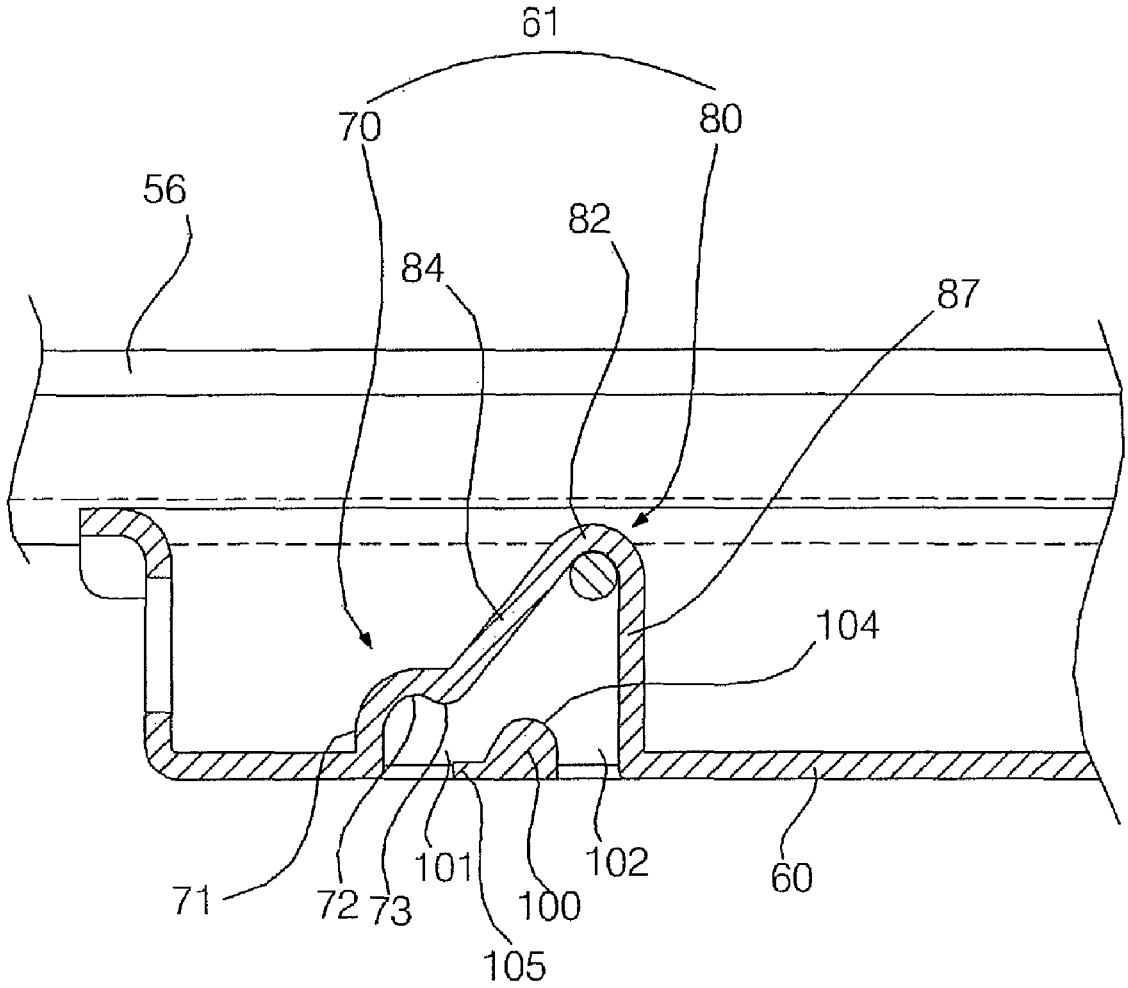
FIG. 8 is a partial cross sectional view of a basket of a rack assembly of a dishwasher according to another embodiment disposed in an upper position.
Figure 9:
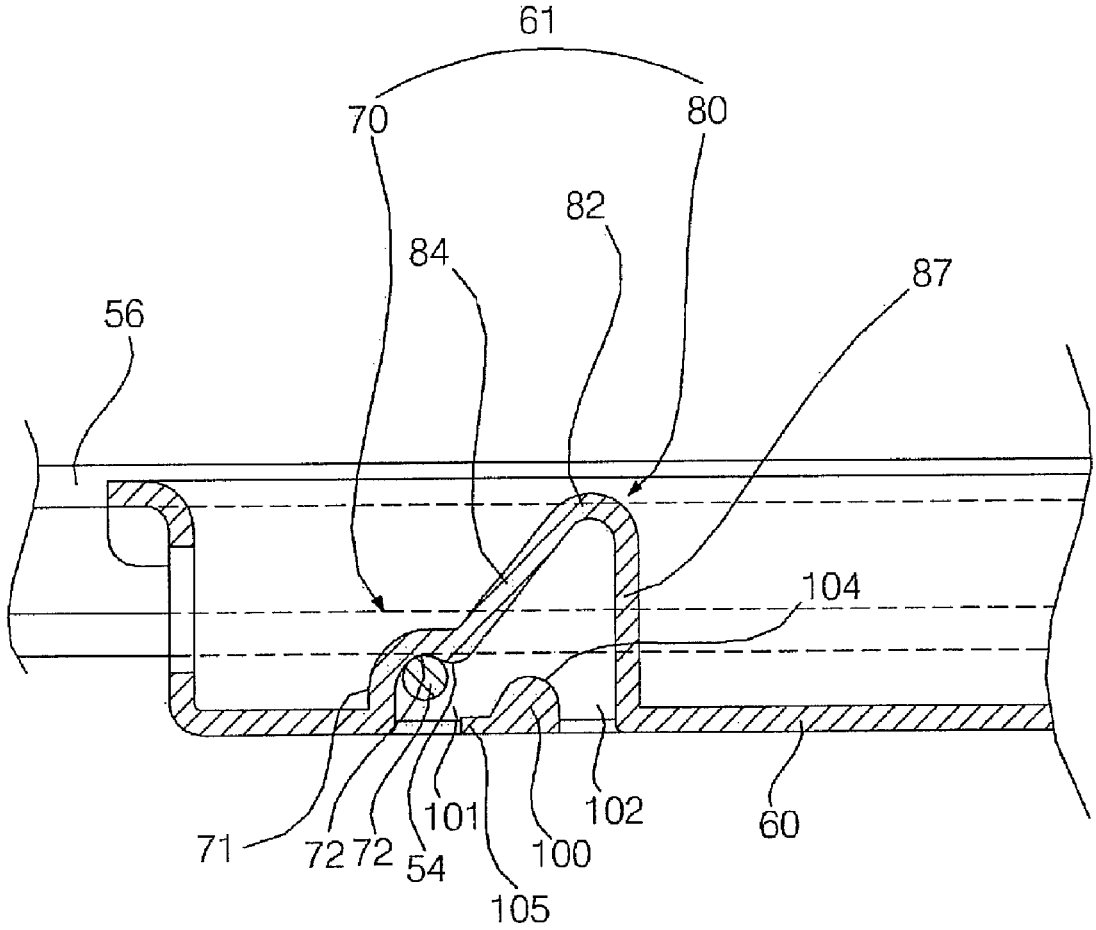
FIG. 9 is a partial cross sectional view of a basket of a rack assembly of a dishwasher according to another embodiment disposed in a lower position.

FIG. 8 is a partial cross sectional view of a basket of a rack assembly of a dishwasher according to another embodiment disposed in an upper position. FIG. 9 is a partial cross sectional view of the basket of FIG. 8 disposed in a lower position.

In this embodiment, as shown in FIGS. 8 and 9, a lower hanging portion 70 and an upper hanging portion 80 may be formed at a front and rear of a recess portion 61 of a basket 60, the portion to be placed on ribs 54 of a frame 50. As in the previously disclosed embodiments, the lower hanging portion 70 may have a linear portion 71 formed upward from a lower end of the basket 60 and a round portion 72 formed on an upper end of the linear portion 71, for partially surrounding an outer peripheral surfaces of the ribs 54. A boundary region 73 between the round portion 72 and an upper hanging portion 80 may have a smaller height than an upper end of the round portion 72. The upper hanging portion 80 may have a sloping portion 84 sloped between the upper end 82 and the lower hanging portion 70 and a vertical portion 87 formed at an opposite side to the sloping portion 84. A guide 100 configured to be guided to the ribs 54 may be formed on the basket 60 (60A, 60B). The guide 100 allows the lower hanging portion 70 and the upper hanging portion 80 to slide along the ribs 54, without moving to far away from the ribs 54 when the basket 60 (60A, 60B) is moved. The guide 100 may be positioned approximately at a lower side of the sloping portion 84 and spaced apart therefrom.

The guide 100 may be formed at an interval from the lower hanging portion 70 and the upper hanging portion 80 slightly greater than a thickness of the ribs 54 and passages 101 and 102 through which the ribs 54 may pass may be formed adjacent the lower hanging portion 70 and the upper hanging portion 80. A sloping plane 103 of the guide 100 may be formed facing the sloping portion 84 of the upper hanging portion 80, and a vertical plane 104 thereof may be formed facing the vertical portion 87 of the upper hanging portion 80. The guide 100 may have a front guide portion 105 formed at a front end thereof and projecting toward a lower end of the linear portion 71 of the lower hanging portion 70, configured to guide backward and forward movement of the basket 60 (60A, 60B).

In the rack of the dishwasher according to this embodiment, when the recess portion 61 is placed on the ribs 54 so that the ribs 54 may pass through a rear passage 102 of the guide 100, as shown in FIG. 8, the upper end 82 of the upper hanging portion 80 is placed on the ribs 54, the basket 60 (60A, 60B) is stopped at the front, rear and lower sides of the ribs 54, and the basket 60 (60A, 60B) is supported on the ribs 54 in a lower position. Further, if the basket 60 (60A, 60B) is pushed rearward when a height of the basket 60 (60A, 60B) is large, for example, when the upper end 82 of the upper hanging portion 80 is placed on the ribs 54, an overall height of the basket 60 is increased and a sloping portion 84 of the upper hanging portion 54 slides along the ribs 54. At this time, the guide 100 helps prevent the upper hanging portion 80, especially, the sloping portion 84, from getting to far away from the ribs 54 as it is guided to the ribs 54, and the height of the basket 60 (60A, 60B) is increased as the basket 60 (60A, 60B) is stably moved into position and thus increased in height.

In the basket, the boundary region 73 between the lower hanging portion 70 and the upper hanging portion 80 slides along the ribs 54, and as shown in FIG. 9, as the round portion 72 of the lower hanging portion 70 is placed on the ribs 54, the lower hanging portion 70 is stopped at the rear and lower sides of the ribs 54, and the basket 60 (60A, 60B) is supported on the rib 54 in an upper position or overally heightened state. If the basket 60 (60A, 60B) is lifted upward, after the lower hanging portion 70 of the basket 60 (60A, 60B) has been placed on the rib 54, the rib 54 passes through the rear gap 102 of the guide 100, and the basket 60 (60A, 60B) is separated from the frame 50.

Figure 10:
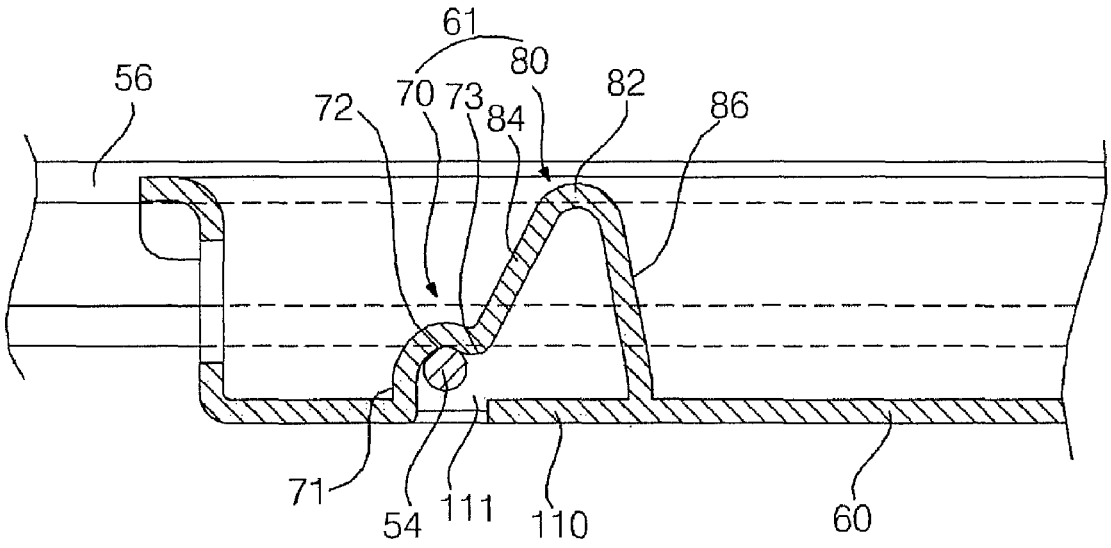
FIG. 10 is a partial cross sectional view of a basket of a rack assembly of a dishwasher according to another embodiment disposed in an upper position.
Figure 11:
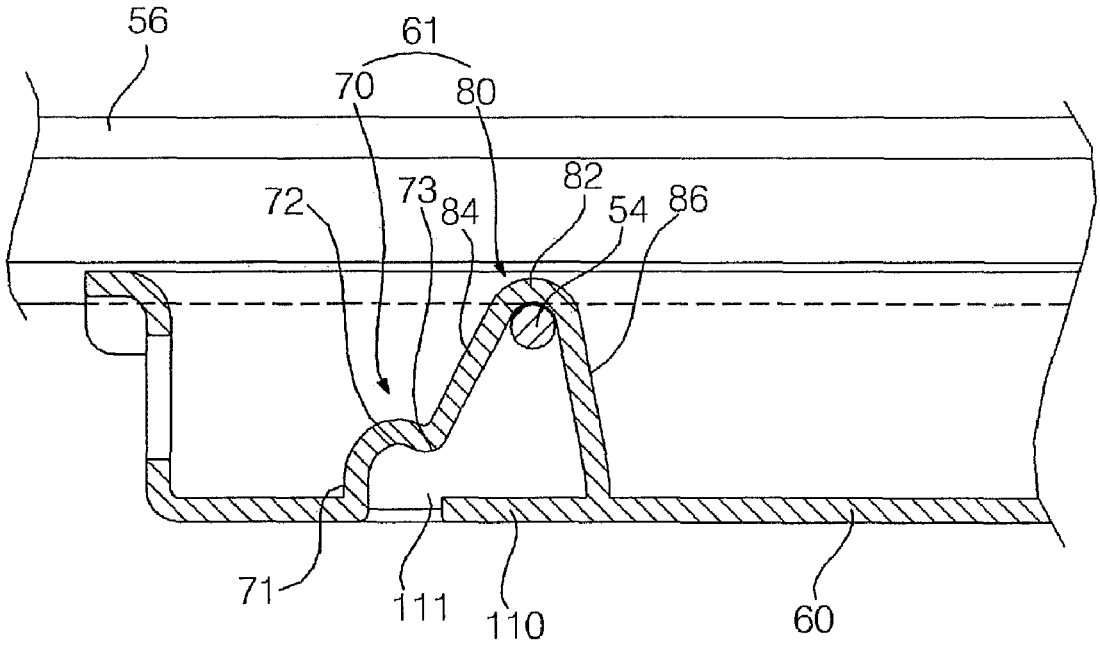
FIG. 11 is a partial cross sectional view of a basket of a rack assembly of a dishwasher according to another embodiment disposed in a lower position.
Figure 12:
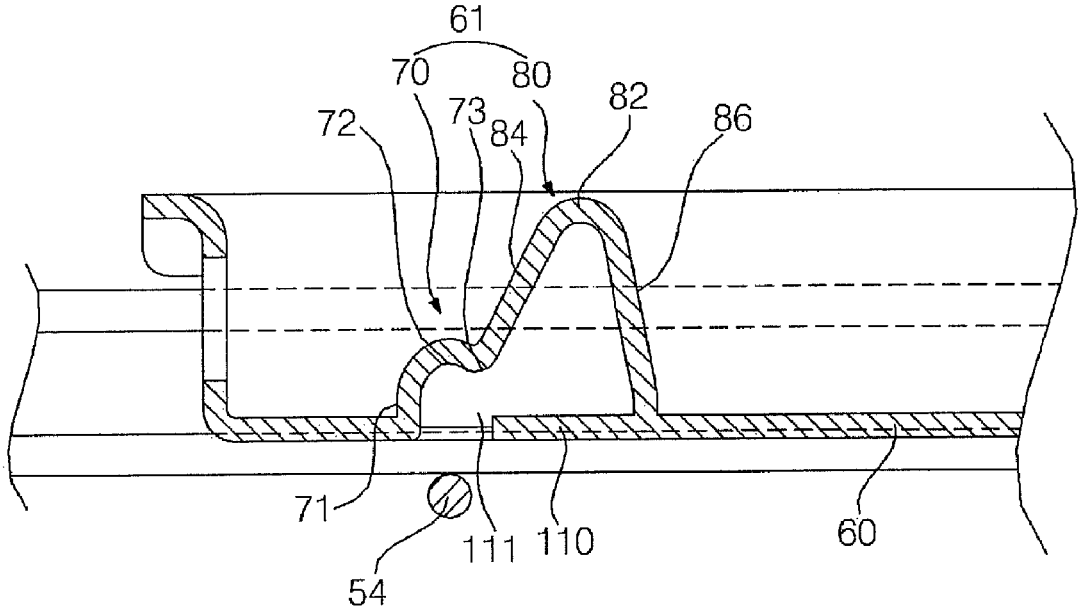
FIG. 12 is a partial cross sectional view of a basket of a rack assembly of a dishwasher according to another embodiment separated from a frame.

FIG. 10 is a partial cross sectional view of a basket of a rack assembly of a dishwasher according to another embodiment disposed in an upper position. FIG. 11 is a partial cross sectional view of the basket of FIG. 10 disposed in a lower position. FIG. 12 is a partial cross sectional view of the basket of FIG. 10 separated from a frame.

In the rack according to this embodiment, the lower hanging portion 70 and the upper hanging portion 80 may be formed in the front-to-rear direction in the recess portion 61 of the basket 60 (60A, 60B) that is placed on the ribs 54 of the frame 50 as in the previously disclosed embodiments. The lower hanging portion 70 may include a linear portion 71 formed upward in a linear shape from a lower end of the basket 60 (60A, 60B) and a round portion 72 formed on an upper end of the linear portion 71, for partially surrounding an outer peripheral surface of the ribs 54. A boundary region 73 between the round portion 72 and the upper hanging portion 70 may have a smaller height than an upper end of the round portion 72.

The upper hanging portion 80 may include sloping portions 84 and 86 that are sloped at the portions between the upper end 82 and the front and lower hanging portion 70 and a stopper 110, so that it is formed overall in an approximately 'V' shape in cross section. The upper end 82 may be formed such that its shape corresponds to the ribs 54, for example, in a rounded shape, in order to reduce a height of the basket 60 (60A, 60B) as much as possible.

The basket 60 (60A, 60B) may have the stopper 110 which stops the ribs 54 when the basket 60 is lifted upward, when one of the lower hanging portion 70 and the upper hanging portion 80 is placed on the ribs 54. The stopper 110 functions to prevent the basket 60 (60A, 60B) and the rib 54 from being easily separated from each other or from being arbitrarily separated by vibration of the rack of the dishwasher.

Hereinafter, a description of the stopper 110 positioned at the lower side of the upper hanging portion 80 is set forth herein below.

The stopper 110 may project forward from the lower end of the rear side of the upper hanging portion 80, and a gap 111 may be formed between the stopper 110 and the lower end of the front side of the lower hanging portion 70. In this embodiment, when the recess portion 61 is placed on the ribs 54 so that the ribs 54 passes through the gap 111 between the stopper 110 and the lower hanging portion 70, the lower hanging portion 80 is, as shown in FIG. 10, placed on the ribs 54, the basket 60 (60A, 60B) is stopped at the front, rear and lower sides of the ribs 54, and the basket 60 (60A, 60B) is supported on the ribs 54 in a upper position or heightened stated.

As above, if the basket 60 (60A, 60B) is pushed forward when a height of the basket 60 is small, the boundary region 73 between the lower hanging portion 70 and the upper hanging portion 73 slides along the ribs 54. Afterwards, an overall height of the basket 60 is decreased, and as shown in FIG. 11, the upper end 82 of the upper hanging portion 80 is placed on the ribs 54. The basket 60 (60A, 60B) is stopped at the front, rear and lower sides of the ribs 54, and the basket 60 (60A, 60B) is supported on the ribs 54 in a lower position.

Meanwhile, if the basket 60 is lifted upward, with the upper hanging portion 80 of the basket 60 being placed on the ribs 54, the stopper 110 is stopped upward at the ribs 54 and the movement of the basket 60 is restricted. If the basket 60 is pushed rearward, with the stopper 110 being stopped upward at the ribs 54, the stopper 110 deviates from the lower side of the ribs 54, and the linear portion 71 of the lower hanging portion 70 is stopped at the rear of the ribs 54. Afterwards, if the basket 60 is lifted upward again, the ribs 54 pass through the gap 111 between the stopper 110 and the lower hanging portion 70 and the basket 60 is separated from the frame 50, as shown in FIG. 12.

Figure 13:
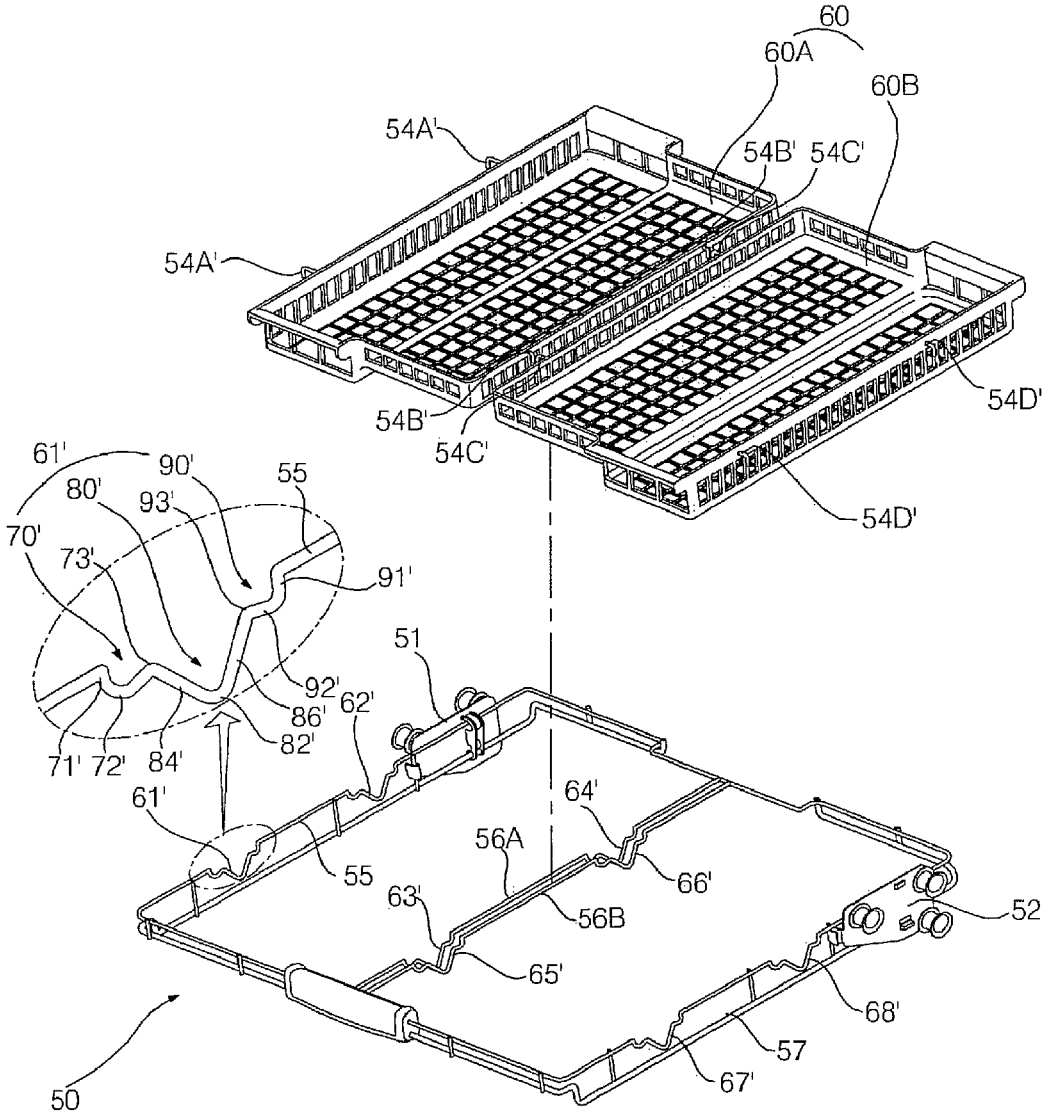
FIG. 13 is an exploded perspective view of a frame and a basket of a rack assembly of a dishwasher according to another embodiment.
Figure 14:
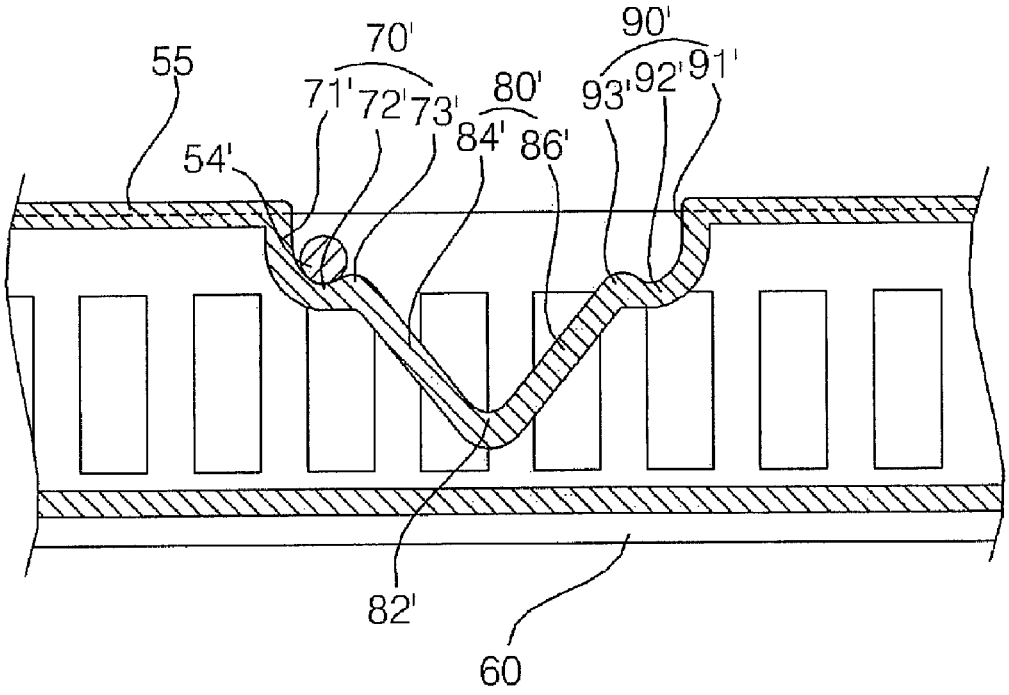
FIG. 14 is a partial cross sectional view of a basket of a rack assembly of a dishwasher according to another embodiment disposed in an upper position.
Figure 15:
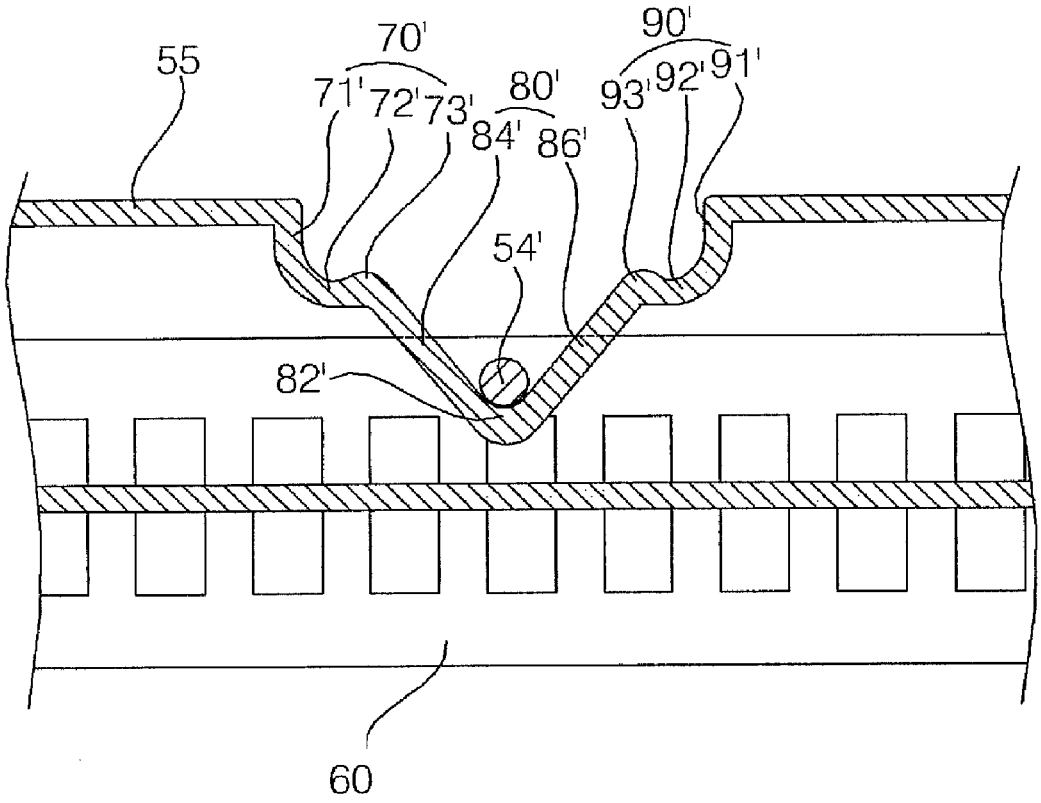
FIG. 15 is a partial cross sectional view of a basket of a rack assembly of a dishwasher according to another embodiment disposed in a lower position.

FIG. 13 is an exploded perspective view of a frame and a basket of a rack assembly of a dishwasher according another embodiment. FIG. 14 is a partial cross sectional view of the basket of FIG. 13 disposed in an upper position. FIG. 15 is a partial cross sectional view of the basket of FIG. 13 disposed in a lower position.

In the rack shown in FIGS. 13-15, ribs 54' (54A', 54B', 54C', 54D') may be formed on basket 60 (60A, 60B), and a plurality of stopping portions 70', 80', and 90' may be formed on a frame 50 and stopped as the ribs 54' are placed thereon. The ribs 54' may project laterally from both left and right side faces of the baskets 60 (60A, 60B).

The ribs 54' may include horizontal portions that horizontally project from both left and right side faces of the basket 60 (60A, 60B) and vertical portions that extend or curve downward from the ends of the horizontal portions and stop at the sides of the frame 50 in a lateral direction. That is, cross sections of the ribs 54' may be formed in an L-shape on side faces of the baskets 60A and 60B so that the ends are formed in a curved shape. The horizontal portions of the ribs 54' may be formed in a cylindrical shape so that the baskets 60 (60A, 60B) may easily slide along the ribs 54' at the time of backward and forward movement of the baskets 60 (60A, 60B).

The ribs 54 may include left ribs 54A' and 54C' that project toward the left from the left side face of the baskets 60 (60A, 60B) and right ribs 54B' and 54D' that project toward the right from the right side face of the baskets 60 (60A, 60B). A plurality of each of the ribs 54A', 54B', 54C', and 54D' may be formed at the side faces of the basket 60 (60A, 60B) spaced apart from each other in a front-to-rear direction. A basket 60 (60A, 60B) will be described with respect to a case in which front ribs are formed between a center and front end of the side faces of the basket 60 (60A, 60B), and rear ribs are formed between the center and rear end of the side faces of the basket 60 (60A, 60B).

The frame 50 may be formed such that the stopping portions 70', 80', and 90' are successively formed in a front-to-rear direction at bar portions 55, 56A, 56B, and 57, which extend longitudinally from a front end to a rear end of the frame 50. A height of stopping portions 70' and 90' may be different from a height of the stopping portion 80'.

The plurality of stopping portions 70', 80', and 90' may be formed of multistage curved portions 61', 62', 63', 64', 65', 66', 67', and 68' that are curved in a multistage fashion at the bar portions 55', 56A, 56B, and 57 of the frame 50 so that the lower ends have a different height. The aforementioned multistage curved portions (hereinafter, referred to as "curved portions") may be formed corresponding to the ribs 54'. The curved portions may be formed in a front-to-rear direction with an interval therebetween corresponding to and at least as long as an end of spacing between ribs 54'.

That is, the left front and rear curved portions 61' and 62' for placing the left rib 54A' of the left basket 60A thereon may be formed at the front and rear of the left bar portion 55 of the bar portions 55, 56A, 56B, and 57, while center left front and rear curved portions 63' and 64' for placing the right rib 54B' of the left basket 60A thereon may be formed at the front and rear of the center left bar portion 56A. Further, the center right front and rear curved portions 65' and 66' for placing the left rib 54C' of the right basket 60B thereon may be formed at the front and rear of the center right bar portion 56B of the bar portions 55, 56A, 56B, and 57, while right front and rear curved portions 67' and 68' for placing the right rib 54D' of the right basket 60B thereon may be formed at the front and rear of the right bar portion 57.

Meanwhile, the aforementioned curved portions 61', 62', 63', 64', 65', 66', 67', and 68' of the basket 60 (60A, 60B) may have the same structure. Only one 61' of the curved portion will be described in detail below for convenience of description.

Each of the lower ends of the plurality of stopping portions 70', 80', and 90' may have a height difference of greater than three stages. Hereinafter, a description thereof will be made with respect to a case in which each lower end has a height difference of two stages.

The upper stopping portions 70' and 90' may be formed at a front and rear of the lower hanging portion 80'. Therefore, the front upper stopping portion 70' may be formed at the front side in the front-to-rear direction of the basket 60 (60A, 60B), the lower stopping portion 80' may be formed at a center, and the rear upper stopping portion 90' may be formed at the rear side.

Further, the upper stopping portions 70' and 90' may be stepped from an upper end of the frame 50. Furthermore, the upper sloping portions 70' and 90' may have the same shape and may be symmetrical with respect to the lower stopping portion 80'.

The front upper stopping portion 70' may have a linear portion 71' that extends downward in a linear shape from the upper end of the frame 50 and a round portion 72' formed on the lower end of the linear portion 71', for partially backing the ribs 54 on the lower end of the linear portion 71'. A boundary region 73' between the round portion 72' and the lower stopping portion 80' may have a larger height than the lower end of the round portion 72' so that the boundary region 73' may be stopped at a rear of the ribs 54' when the ribs 54' are placed on the round portion 72'.

The lower end 82' of the lower stopping portion 80' may be lower than the front upper stopping portion 70' and the rear upper stopping portion 80'. The lower stopping portion 80' may include sloping portions 84' and 86' that are sloped at portions between the lower end 82' and the front and rear upper stopping portions 70' and 90', so that it is formed in an overall approximately 'V' shape in cross section. The lower end 82' of the lower stopping portion 80' may be formed in such a shape that corresponds to the ribs 54', for example, in a rounded shape, in order to reduce the height of the basket 60 (60A, 60B) as much as possible.

The rear upper stopping portion 90' may have a linear portion 91' that extends downward in a linear shape from the upper end of the frame 50 and a round portion 92' formed on the lower end of the linear portion 91', for partially backing the ribs 54' on the lower end of the linear portion 91'. A boundary region 93' between the round portion 92' and the lower stopping portion 80' may have a larger height than the lower end of the round portion 92' so that the boundary region 93' may be stopped at the front of the ribs 54' when the round portion 92' is placed on the ribs 54'.

In this embodiment, when the ribs 54' of the basket 60 (60A, 60B) are placed on the recess portions 61' and the basket 60 (60A, 60B) is pushed rearward, as shown in FIG. 14, the ribs 54' are placed on the front lower stopping portion 70' and stopped at the front and rear and lower side of the front upper stopping portion 70', and the basket 60 (60A, 60B) is supported on the front upper stopping portion 70' in an overall heightened state. On the other hand, when the ribs 54' of the basket 60 are placed on the recess portion 61' and the basket 60 is pulled forward, the ribs 54' are placed on the rear upper stopping portion 90' of the plurality of stopping portions 70', 80', and 90' and stopped at the front and rear and lower side of the rear upper stopping portion 90', and the basket 60 (60A, 60B) is supported on the rear upper stopping portion 90' in an overall heightened state similar to when the ribs 54' are supported on the front upper stopping portion 70'.

However, when the basket 60 (60A, 60B) is pulled forward or pushed rearward, with the ribs 54' of the basket 60 being placed on one of the upper stopping portions 70' and 90', the ribs 54' slide along one of the boundary regions 73' and 93' between the upper stopping portions 70' and 90' and the lower stopping portion 80', and the position of the basket 60 (60A, 60B) is slightly moved in a backward and forward direction as its overall height is reduced, and the ribs 54' are positioned between the boundary regions 84' and 86' of the lower stopping portion 80'. When the ribs 54' are placed on the lower end 82' of the lower stopping portion 80', the basket 60 (60A, 60B) is stopped at the front, rear and lower side of the lower stopping portion 80', and the basket 60 (60A, 60B) is supported on the ribs 54' in a lower state.

A dishwasher according to embodiments disclosed herein has at least the following advantages.

The dishwasher according to embodiment disclosed herein has a simpler structure and is more easily manufactured, in comparison to dishwashers having respective hanging members formed at a front, rear, left, and right of a frame. Rather, ribs are formed on a frame, a plurality of hanging portions for placing the ribs thereon is formed on the basket, and a height of part of the plurality of hanging portions is different from that of the other hanging portions.

Further, the dishwasher according to embodiments disclosed herein does not require the inconvenience of lifting the basket, rotating it 90°, and then placing it again on the frame. Rather, the height of the basket may be adjusted by back and forth movement of the basket via a plurality of hanging portions. Thus, it is convenient to use.

Moreover, the height of the dishwasher according to embodiments disclosed herein is adjustable while a width of back and forth movement of the basket is minimized in comparison to the case where a plurality of hanging portions are spaced from each other. This is because a plurality of hanging portions may be successively formed in a back and forth direction of the basket. Thus, is easy for a user to manipulate adjustment of the height.

Also, the basket of the dishwasher according to embodiments disclosed herein is easy to mount because the ribs may be easily entered into the lower hanging portion by sliding the lower end of the basket back and forth while placing the same on the ribs since the lower hanging portion may be stepped from the lower end of the basket.

Additionally, the back and forth movement operation of the basket of the dishwasher according to embodiments disclosed herein has the advantage that is easy to operate and the height of the basket may be stably adjusted since a guide to be guided to the ribs is formed on the basket.

Also, the dishwasher according to embodiments disclosed herein may include a stopper to be stopped upward at the ribs formed at the lower position of one of the plurality of hanging portions. The stopper may prevent the basket and the frame from being easily and arbitrarily separated from each other.

In the thus-constructed dishwasher according to embodiments disclosed herein, height adjustment is easier as compared to a case in which the basket is lifted, rotated 90°, and then placed again on the frame because ribs are formed on the basket, a plurality of stopping portions for placing the ribs thereon is formed on the frame, and the height of part of the plurality of stopping portions is different from the height of the other stopping portions.

Moreover, in the thus-constructed dishwasher according to embodiments disclosed herein, there is no need to take the entire rack out of the washing cabinet to control of the height of the basket because the height of the basket may be adjusted by a simple operation of moving the basket back and forth when the rack is positioned inside the washing tub. Thus, it is possible to adjust the height of the basket when the rack is disposed inside the washing tub.

Embodiments disclosed herein provide a dishwasher which may adjust a vertical position of a basket by a simple operation of moving the basket backward and forward. Further, embodiments disclosed herein provide a dishwasher which may adjust a height of a basket of a rack, the rack being disposed inside a washing tub or cabinet. Furthermore, embodiments disclosed herein provide a dishwasher which may simplify a number of parts and adjust a height of a basket using a simple structure.

There is provided according to one embodiment a dishwasher that includes a washing tub or cabinet, a frame disposed in the washing tub and having ribs, and a basket which has a plurality of hanging portions to be placed on the ribs, a height of part of the plurality of hanging portions being different from a height of the other hanging portions. The plurality of hanging portions may be successively formed in a back-and-forth direction of the basket. The plurality of hanging portions may be formed of recess portions formed in a multistage fashion at both left and right sides of the basket, respectively.

The ribs may project to the left and right from bar portions longitudinally formed back and forth between the front end and rear end of the frame. The ends of the ribs may be curved upward so that the basket is stopped in a lateral direction.

Of the plurality of hanging portions, lower hanging portions may be formed at the front and rear of an upper hanging portion. A guide to be guided to the ribs may be formed on the basket. The guide may have passages through which the ribs pass formed between the lower hanging portions and the upper hanging portion.

The basket may have a stopper formed at a lower position of one of the upper hanging portion and lower hanging portion and stopped upward at the ribs. The basket may be formed in a manner that the lower hanging portions are stepped from the lower end of the basket.

The basket may be formed in a manner that boundary regions between the lower hanging portions and the upper hanging portion is lower than the upper ends of the lower hanging portions. The basket may be formed in a manner that the portions between the upper end of the upper hanging portion and the lower hanging portions are sloped.

Additionally, there is provided a dishwasher according to one embodiment, which includes a washing tub or cabinet, a basket having ribs, and a frame disposed in the washing tub and having a plurality of stopping portions formed successively in a back and forth direction for placing the ribs, a height of part of the plurality of stopping portions being different from a height of the other stopping portions. The plurality of stopping portions may be formed of curved portions that are curved in a multistage fashion at the left and right sides of the frame so that the lower ends have a different height.

The frame may be formed such that the upper stopping portions are stepped from the upper end of the frame. The frame may be formed such that boundary regions between the upper stopping portions and the lower stopping portion are higher than the lower ends of the upper stopping portions. The frame may be formed in a manner that the portions between the lower end of the lower stopping portion and the upper stopping portions are sloped.

Additionally, there is provided a dishwasher according to an embodiment that includes a washing tub or cabinet, a frame disposed inside the washing tub, and a basket, which is placed on the frame, and whose height is adjusted by back and forth movement. A plurality of hanging portions to be placed on the frame may be formed successively on the basket in a back and forth direction, and the height of part of the plurality of hanging portions may be different from the height of the other hanging portions.

A plurality of stopping portions for placing the basket on the frame may be formed successively on the frame in a back and forth direction, and a height of part of the plurality of stopping portions may be different from a height of the other stopping portions.

In the thus-constructed dishwasher according to embodiments, there is no need to and inconvenience of lifting the basket, rotating it 90°, and then placing it again on the frame because a height of the basket may be adjusted by a simple operation of moving the basket in a backward and forward direction. Thus, the dishwasher according to embodiments is convenient to use, and the structure is simpler than related art devices. Further, it is easy to manufacture if respective stopping members are provided at the left, right, left, and right of the frame. Moreover, in the thus-constructed dishwasher according to embodiments, there is no need to take the entire rack out of the washing tub to control a height of the basket because the height of the basket can may adjusted by a simple operation of moving the basket back and forth when the rack is positioned inside the washing tub, and it is possible to adjust the height of the basket when the rack is disposed inside the washing tub.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A dishwasher, comprising:

a washing cabinet; and at least one rack assembly disposed within the washing cabinet configured to hold dishware to be washed therein, wherein the at least one rack assembly comprises:

a frame having a plurality of ribs; and at least one basket having a plurality of hanging portions configured to be placed on respective ones of the plurality of ribs, wherein:

a height of a first hanging portion of the plurality of hanging portions is different from a height of a second hanging portion of the plurality of hanging portions, wherein:

the first hanging portion is laterally spaced from the second hanging portion, the first hanging portion contacts a first rib to set the basket at a first height, and the second hanging portion contacts the first rib to set the basket at a second height different from the first height within the washing cabinet, and the basket is located at a first lateral position when the first rib is in contact with the first hanging portion, and the basket is located at a second lateral position when the first rib is in contact with the second hanging portion, wherein the plurality of hanging portions is successively formed in a front-to-rear direction of the at least one basket.

2. The dishwasher of claim 1, wherein the plurality of hanging portions comprises recess portions formed in a multistage fashion at both left and right sides of the at least one basket.

3. The dishwasher of claim 2, wherein the plurality of ribs project to the left and right from bar portions that longitudinally extend between a front end and a rear end of the frame.

4. The dishwasher of claim 1, wherein the first rib is curved and wherein the first and second hanging portions have complementary curves to at least partially surround the first rib, the basket prevented from moving in a lateral direction while the first rib is in contact with respective ones of the first and second hanging portions.

5. The dishwasher of claim 1, wherein the plurality of hanging portions each comprise a guide section configured to guide the first rib into contact with at least one of the first hanging portion or the second hanging portion.

6. The dishwasher of claim 5, wherein the guide section has or is located adjacent at least one passage through which the first rib passes to advance towards contact with at least one of the first hanging portion or the second hanging portion, and wherein the at least one passage is formed between the first hanging portion and the second hanging portion.

7. The dishwasher of claim 1, wherein the plurality of hanging portions each comprise a stopper formed below one of the first hanging portion or the second hanging portion.

8. The dishwasher of claim 1, wherein the first hanging portion is stepped from a lower end of the at least one basket.

9. The dishwasher of claim 1, wherein a boundary region between the first hanging portion and the second hanging portion is at a height lower than an upper surface one of the first or second hanging portions.

10. The dishwasher of claim 1, wherein a portion between the first and second hanging portions is sloped to guide movement of the first rib from the first hanging portion to the second hanging portion.

11. The dishwasher of claim 1, wherein the at least one basket comprises a plurality of baskets configured to be disposed side by side within the frame.

12. The dishwasher of claim 1, wherein the at least one rack assembly is configured to be inserted into and withdrawn from the washing cabinet.

13. A dishwasher, comprising:

a washing cabinet;

at least one frame disposed within the washing cabinet;

at least one basket configured to be placed on the at least one frame, a first hanging portion coupled to a second hanging portion, wherein:

the first hanging portion is laterally spaced from the second hanging portion, the first hanging portion sets the basket at a first height and the second hanging portion sets the basket at a second height within the washing cabinet, the basket is located at a first horizontal position at the first height and is located at a second horizontal position at the second height, wherein the first and second hanging portions are formed successively on the at least one basket in a front-to-rear direction.

14. The dishwasher of claim 13, wherein the first and second hanging portions are configured to be placed on the at least one frame.

15. A rack assembly for a dishwasher, comprising:

at least one frame; and at least one basket configured to be placed on the at least one frame and whose height is adjustable by backward and forward movement, wherein:

the basket includes first and second hanging portions, the first hanging portion contacts a first rib coupled to the frame to set the basket at a first height, and the second hanging portion contacts the first rib to set the basket at a second height different from the first height, and the basket is located at a first horizontal position relative to the frame when the first rib is in contact with the first hanging portion, and the basket is located at a second lateral position relative to the frame when the first rib is in contact with the second hanging portion, wherein the first and second hanging portions are successively formed in a front-to-rear direction of the at least one basket.

16. A dishwasher comprising the rack assembly of claim 15.

17. The dishwasher of claim 1, further comprising:

a guide section between the first and second hanging portions, a first passage adjacent a first side of the guide section to allow the first rib to contact the first hanging portion.

18. The dishwasher of claim 17, wherein the guide section includes a leading edge with a predetermined slope.

19. The dishwasher of claim 17, further comprising:

a second passage adjacent a second side of the guide section, wherein the second side is on an side of the guide section that opposes the first side.

20. The dishwasher of claim 1, wherein the first hanging portion includes a curved surface to contact the first rib to set the basket to the first height, and the second hanging portion includes a curved surface to contact the first rib to set the basket at the second height.

21. The dishwasher of claim 20, wherein the curved surface of the first hanging portion and the curved surface of the second hanging surface have different curvatures.

* * * * *